US012239254B2

(12) United States Patent
Jenner

(10) Patent No.: US 12,239,254 B2
(45) Date of Patent: Mar. 4, 2025

(54) BEDDING SYSTEM

(71) Applicant: Makereta Jenner, Auckland (NZ)

(72) Inventor: Makereta Jenner, Auckland (NZ)

( * ) Notice: Subject to any disclaimer, the term of this patent is extended or adjusted under 35 U.S.C. 154(b) by 0 days.

(21) Appl. No.: 18/051,045

(22) Filed: Oct. 31, 2022

(65) Prior Publication Data

US 2024/0138599 A1 May 2, 2024

(51) Int. Cl.
*A47G 9/04* (2006.01)

(52) U.S. Cl.
CPC ..... *A47G 9/04* (2013.01)

(58) Field of Classification Search
CPC ..... A47G 9/02; A47G 9/0207; A47G 9/0238; A47G 9/0261; A47G 9/04; A47G 2009/0269
See application file for complete search history.

(56) References Cited

U.S. PATENT DOCUMENTS

| | | | | | |
|---|---|---|---|---|---|
| 3,965,504 | A * | 6/1976 | Ainsworth | A47G 9/02 | 5/500 |
| 4,631,765 | A * | 12/1986 | Casey | A47G 9/0207 | 428/33 |
| 5,070,561 | A * | 12/1991 | Keidser | A47G 9/0284 | 5/482 |
| 5,092,010 | A * | 3/1992 | Wong | A47G 9/0284 | 5/493 |
| 5,321,862 | A * | 6/1994 | Campbell | A47C 21/022 | 5/923 |
| 5,732,424 | A * | 3/1998 | Bond | A47G 9/02 | 5/498 |
| 6,757,923 | B2 | 7/2004 | Sopher et al. | | |
| 7,093,310 | B2 | 8/2006 | Barros | | |
| 8,407,836 | B1 | 4/2013 | Sacherman et al. | | |
| 9,549,625 | B1 * | 1/2017 | Wilkinson | A47G 9/0223 | |
| 9,601,034 | B2 | 3/2017 | Jensen et al. | | |
| 9,675,189 | B2 | 6/2017 | Jensen et al. | | |
| 9,997,089 | B2 | 6/2018 | Jensen et al. | | |
| 10,918,230 | B1 | 2/2021 | Dompierre | | |
| 11,064,825 | B2 | 7/2021 | Serafini | | |
| 2004/0031098 | A1 * | 2/2004 | Hollander | A47G 9/02 | 5/482 |

(Continued)

FOREIGN PATENT DOCUMENTS

| | | | |
|---|---|---|---|
| WO | 2021113243 | A1 | 6/2021 |
| WO | 2022073076 | A1 | 4/2022 |
| WO | 2022133524 | A1 | 6/2022 |

*Primary Examiner* — George Sun
(74) *Attorney, Agent, or Firm* — Tatonetti IP

(57) ABSTRACT

A bedding system is configured with a bottom blanket, a top sheet, a bottom sheet, and a top blanket. The bottom blanket at least partially encapsulates a mattress or other structure. The bottom sheet can be releasably connected to the bottom blanket, having mating fastening mechanisms juxtaposition along the bottom blanket's top surface and the bottom sheet's bottom surface. The top sheet can be releasably connected to the top blanket, having mating fastening mechanisms juxtaposition along the top surface of the bottom blanket and the bottom surface of the bottom sheet. The bottom sheet has a length and a width less than the length and width of the top surface of the bottom blanket. The top sheet can include three panels extending from their respective sides that are releasably connectable by some attachment mechanism, such as buttons.

19 Claims, 8 Drawing Sheets

(56) References Cited

U.S. PATENT DOCUMENTS

2007/0000053 A1* 1/2007 Yang ..... A47C 31/105 5/493
2007/0245492 A1* 10/2007 Combellick ..... A47G 9/0284 5/482
2008/0104751 A1* 5/2008 Friedland ..... A47G 9/02 5/502
2008/0289104 A1* 11/2008 Rowson ..... A47G 9/02 5/923
2009/0044337 A1* 2/2009 McKee ..... A47G 9/02 5/496
2010/0058537 A1 3/2010 Schuck
2010/0154119 A1 6/2010 Shuttleworth
2010/0251482 A1* 10/2010 MacDonald ..... A47G 9/02 5/494
2011/0023234 A1* 2/2011 Bolish ..... A47G 9/0238 5/496
2012/0060282 A1* 3/2012 Medici ..... A47G 9/0207 5/482
2012/0233776 A1 9/2012 Agarwall
2013/0180050 A1 7/2013 Koci
2013/0269107 A1* 10/2013 Fiene ..... A47G 9/02 5/497
2014/0115781 A1 5/2014 John
2014/0189952 A1* 7/2014 Crispino ..... A47G 9/02 112/475.08
2014/0208508 A1* 7/2014 Mikesell ..... A47G 9/0223 5/497
2014/0373276 A1 12/2014 Fan
2015/0157147 A1 6/2015 Haraszta
2015/0305524 A1* 10/2015 Shilts ..... G08B 21/18 5/636
2016/0022051 A1 1/2016 Ebert
2016/0183689 A1 6/2016 Miner
2016/0242559 A1 8/2016 Hui
2017/0099966 A1* 4/2017 David ..... A47G 9/0261
2017/0127855 A1* 5/2017 Wootten, Jr. ..... A47G 9/0261
2017/0164767 A1* 6/2017 Serafini ..... A47G 9/02
2017/0238717 A1 8/2017 Jensen et al.
2017/0251839 A1* 9/2017 McLeod ..... A47G 9/0246
2017/0318990 A1 11/2017 David
2018/0255945 A1* 9/2018 Stewart ..... A47G 9/04
2018/0360228 A1* 12/2018 Johannessen ..... A47C 27/081
2019/0082865 A1 3/2019 Carlson
2019/0223630 A1* 7/2019 Phan ..... A47G 9/0261
2019/0365123 A1 12/2019 Weinhoffer
2020/0229621 A1 7/2020 Liu
2020/0275790 A1 9/2020 McMullin
2020/0315378 A1* 10/2020 Cooley ..... B32B 7/02
2020/0383503 A1 12/2020 Pesina
2021/0015276 A1 1/2021 Jimenez et al.
2021/0274951 A1 9/2021 Sadar
2021/0401195 A1 12/2021 Miles
2022/0110454 A1 4/2022 Speters
2022/0175160 A1* 6/2022 Guy ..... A47G 9/0261
2022/0192400 A1 6/2022 Brown
2022/0192401 A1 6/2022 Mittal
2022/0202211 A1* 6/2022 Jung ..... A47G 9/04
2022/0400869 A1* 12/2022 Teleshevsky ..... A47G 9/0261
2023/0013670 A1* 1/2023 Pfister ..... A47G 9/02

* cited by examiner

BEDDING SYSTEM

BACKGROUND

It is often difficult for people to keep bedding presentable and tidy, and some types of beds, such as bunk beds, can be even more difficult to keep tidy given the number of sheets and blankets which can fall off the bed, get stuck or scrunched up around the mattress and surrounding areas, among other problems. Problems may be compounded for non-standard beds, such as bunk beds, a crib, a murphy bed, a hospital bed with rails, and military barracks beds, among other beds.

SUMMARY

A bedding system is adaptable to fit onto a mattress, a cot, or other structure and helps maintain the bed structure's tidiness. The implemented bedding system makes it easier to make beds and minimizes the washing of certain components (e.g., sheets, blankets) of the bedding area. In typical implementations, the members may be separate and not fixedly attached to each other. Sheets can be removed weekly or as necessary for washing, and blankets can be washed seasonally or as necessary, but less often than sheets, depending on the user.

The bedding system can include at least four separate members, or components, including a bottom blanket, bottom sheet, top sheet, and top blanket. The bedding system can be arranged such that the top blanket and the bottom blanket can be zipped open on the outside, away from a wall, so the bed maker gains easy access to detach the top and bottom sheets from the bedding system. The top and bottom blankets remain closed on the opposing side, which may be adjacent to a wall.

The bedding system provides bed coverings that feel like traditional bedding while being slept in, top and bottom blankets that can be attached to a mattress, and are easy to keep neat and tidy when not being slept in.

The bedding system may include a bottom blanket, a top blanket, a bottom sheet, and a top sheet. The bottom blanket can be releasably attachable to the top blanket. The bottom sheet has a bottom surface that can be releasably attachable to the top surface of the bottom blanket. The top sheet has a top surface that can be releasably attachable to the bottom surface of the top blanket. The releasable attachment mechanism can be any means, including but not limited to male/female snaps, hook and loop, and zippers, among other fastening mechanisms.

The bottom sheet may have a length and width that are each less than the length and width, respectively, of the top surface of the bottom blanket. In some implementations, the bottom blanket may have a pocket fixedly attached to a plurality of sides of the bottom surface of the bottom blanket. The pocket includes an opening opposing the bottom surface of the bottom blanket. The opening has a width and length at least equal to the width and length of the bottom surface of the bottom blanket. The opening can include an elastic material to close the opening after being fitted onto the structure and securing the bedding system to the structure.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Furthermore, the claimed subject matter is not limited to implementations that solve any or all disadvantages noted in any part of this disclosure. These and various other features will be apparent from a reading of the following Detailed Description and a review of the associated drawings.

DETAILED DESCRIPTION

Figure 1A:
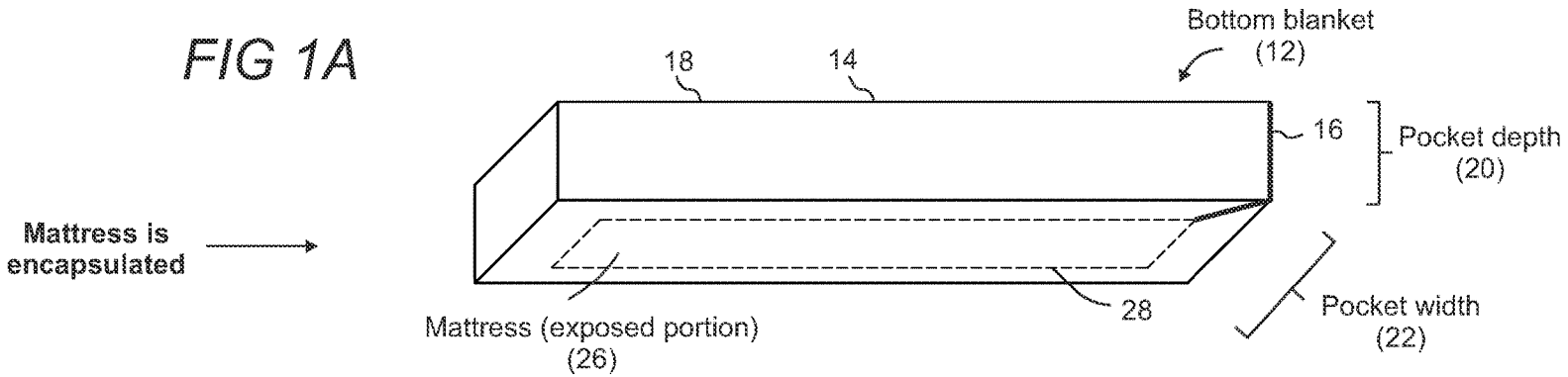
FIG. 1A is a perspective view of an exemplary bottom blanket illustrating a pocket attached to four sides of the top surface.

FIG. 1A shows an illustrative representation of the bottom blanket 12, including a top surface 14 and a pocket 16 attached to four sides 18 of the top surface 14. The pocket 16 can have any suitable height or pocket depth dimension 20 and width dimension 22 to accommodate a mattress 26, or other similar structure, for illustration purposes and not limit the bedding system to any specific structure.

Figure 1B:
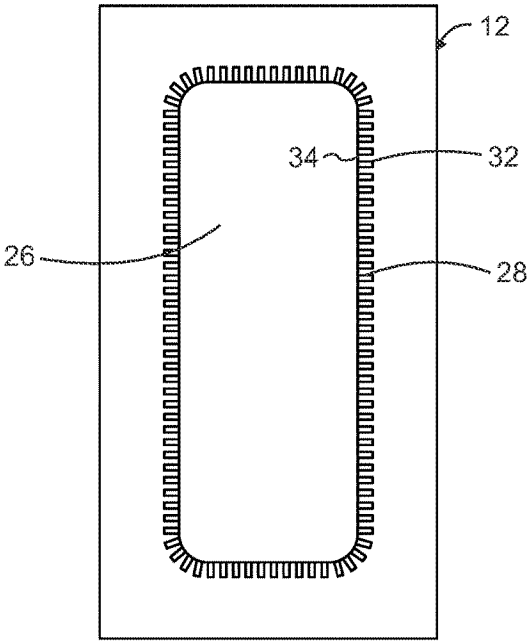
FIG. 1B is a bottom view of the exemplary bottom blanket showing an opening with a closure mechanism.

FIG. 1B shows an illustrative bottom view representation in which the bottom blanket 12 shows an opening 28 with a closure mechanism. The closure mechanism may be an elastic material 32 fixedly attached to the edge 34 of the opening 28. For example, the elastic material 32 may be attached inside the edge 34.

Figure 2:
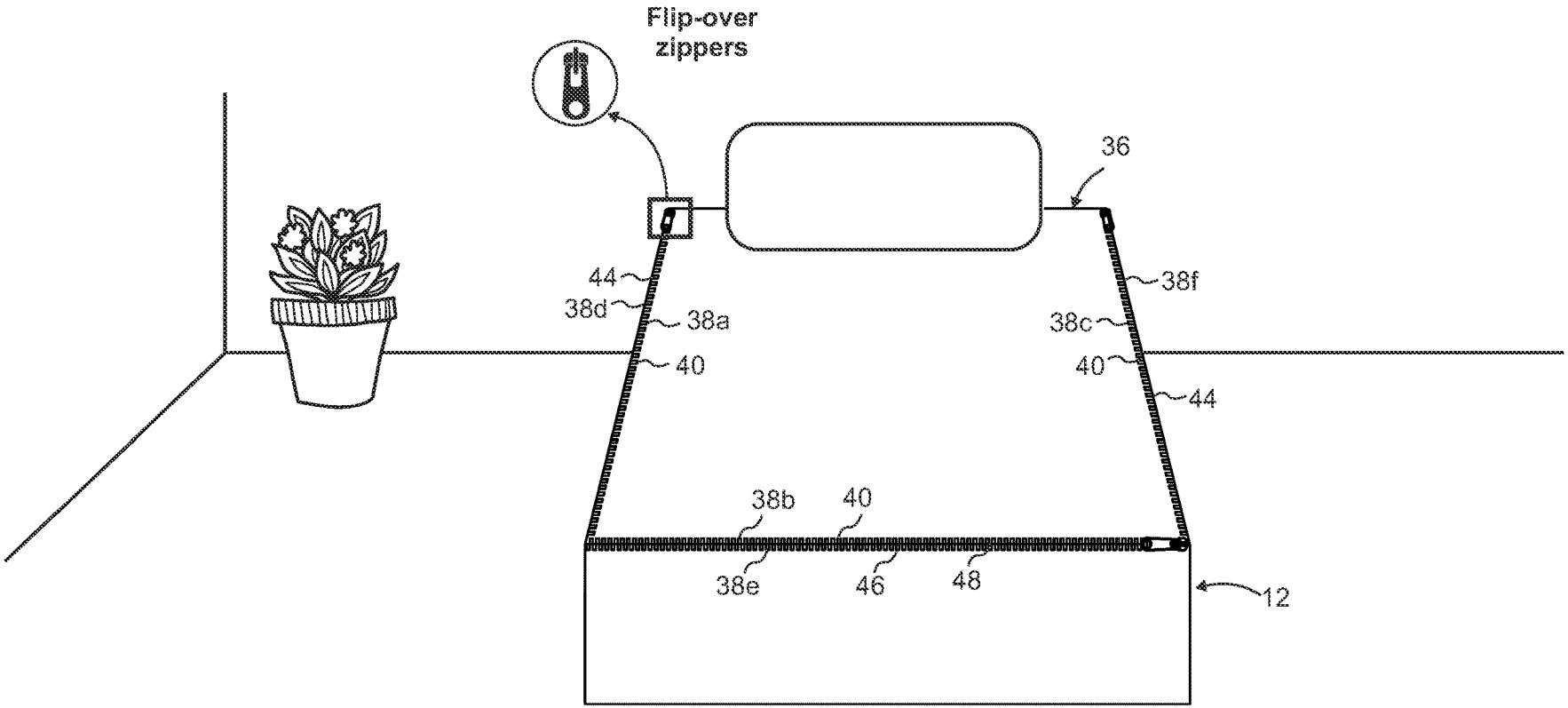
FIG. 2 is a perspective view of a bedding system showing an exemplary top blanket releasably attached to the bottom blanket.

FIG. 2 shows an illustrative perspective representation in which the top blanket 36 is releasably attached to the bottom blanket 12. The releasably attachable mechanism may be independent sets of zippers along at least three sides 40. Top blanket zippers 38*a*, 38*b*, 38*c* may engage with bottom blanket zippers 38*d*, 38*e*, 38*f*, respectively. Specifically, zippers 38*a* and 38*d*, 38*b* and 38*e*, and 38*c* and 38*f* interconnect to secure top blanket 36 to bottom blanket 12. Zippers 38*a-f* are disposed along length dimension 44 of top blanket 36 and bottom blanket 12 on opposing sides and along width dimension 46 across at least one end 48. The plurality of zippers 38*a-f* allows the user the versatility to free their feet and/or sides from being zipped down if they prefer a loose "regular" bedding feel when sleeping. The top and bottom sheets 50, 52 inside top and bottom blankets 36, 12 are removable and allow the user to wash sheets without washing the whole fitted blanket.

Figure 3:
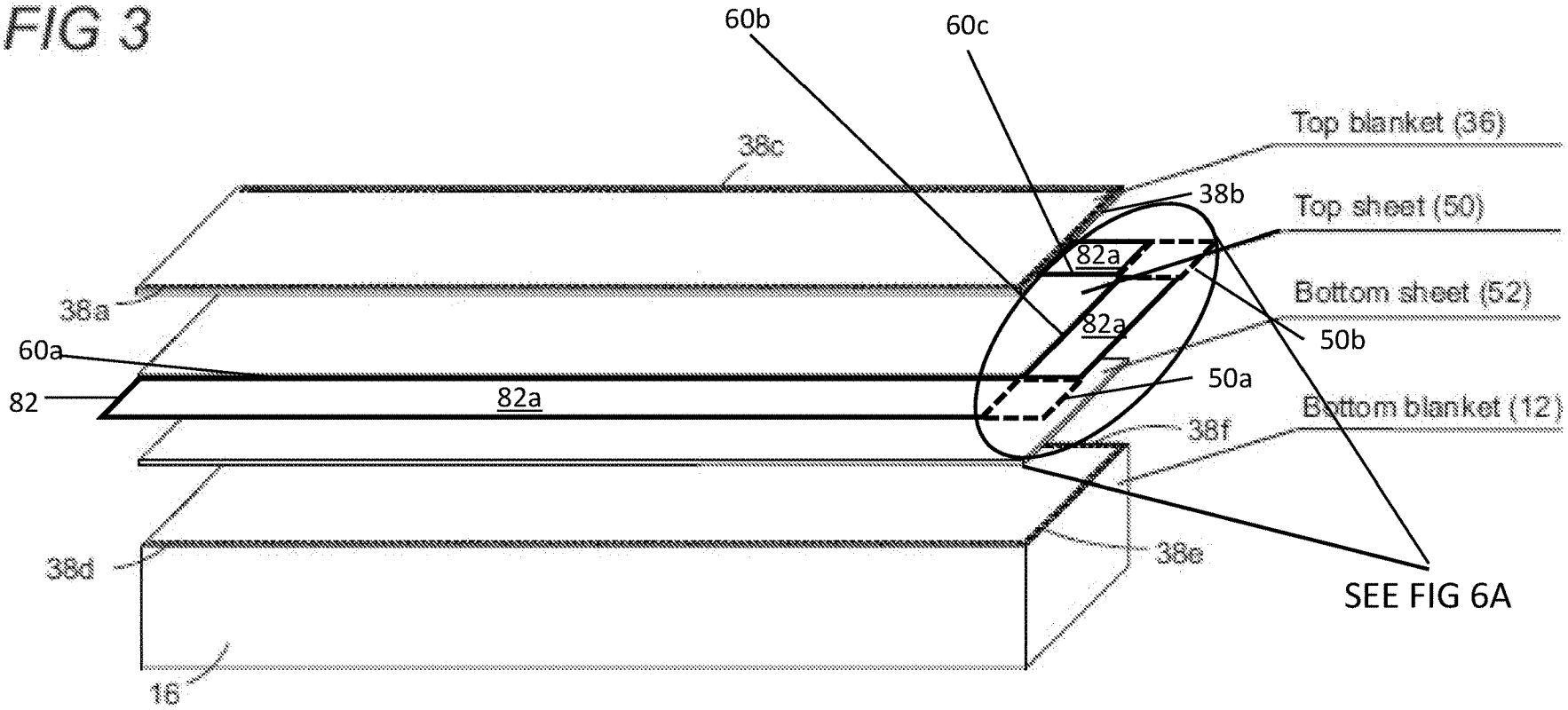
FIG. 3 is an exploded view of the exemplary bedding system illustrating the four separate and independent members of the bedding system.

FIG. 3 shows an illustrative exploded representation in which the bedding system's four separate and independent members are depicted relative to each other. The members are shown in planar view to illustrate relative positioning in relation to the other members for making the bed and not to illustrate their actual dimensions of the exemplary bedding system, discussed in detail below. The top sheet 50 and bottom sheet 52 are disposed between top blanket 36 and bottom blanket 12. FIG. 3 further illustrates the plurality of zippers 38*a-c* of the top blanket 36 and the plurality of zippers 38*d-f* of the bottom blanket 12. Each zipper is a separate and independent releasably attachable mechanism that interconnects with its opposing zipper. Zipper 38*a* interconnects with zipper 38*d*. Zipper 38*b* interconnects with zipper 38*e*. Zipper 38*c* interconnects with zipper 38*f*. In some embodiments, the top sheet 50 can attach directly to top blanket 36, as discussed in detail below. In another embodiment, the bottom sheet 52 is attached directly to the bottom blanket 12, as discussed in greater detail below.

FIG. 3 further illustrates a top sheet panel 82 extending beyond top sheet left edge 60*a*, top sheet end edge 60*b*, and top sheet right edge 60*c* in its untucked position with top sheet top surface 82*a* upwardly disposed. See FIGS. 7A and 7B for the details of the top sheet attachment mechanism 88 disposed on the panel bottom surface 82*b* and top blanket attachment mechanism 90 on the top blanket bottom surface 92 that will attach the top blanket 36 to top sheet 50 when panels 82 are in the tucked position when the top blanket 36 is placed on top of the top sheet 50.

One of ordinary skill in the art will appreciate the many ways to create panels 82. Two examples are disclosed herein for illustration purposes and not to limit the present invention. One embodiment of panels 82 can be sewn or stitched to top sheet edges 60 such as top sheet left edge 60*a*, top sheet end edge 60*b* and top sheet right edge 60*c*. Another embodiment of panels 82 starts with a larger top sheet 50 having width and length dimensions sized to include panels 82. As shown as phantom on FIG. 3, left and right corners 50*a*, 50*b*, respectively, of the top sheet end 60*b* are cut out, whereby the desired panels 82 are formed without sewing or stitching.

Figure 4C:
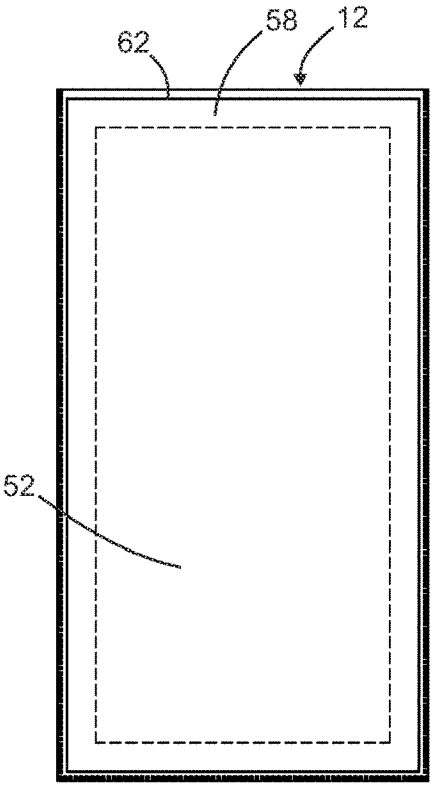
FIG. 4C is a top view of the bottom sheet illustrating one embodiment of the bottom sheet being releasably attached to the bottom blanket.
Figure 4B:
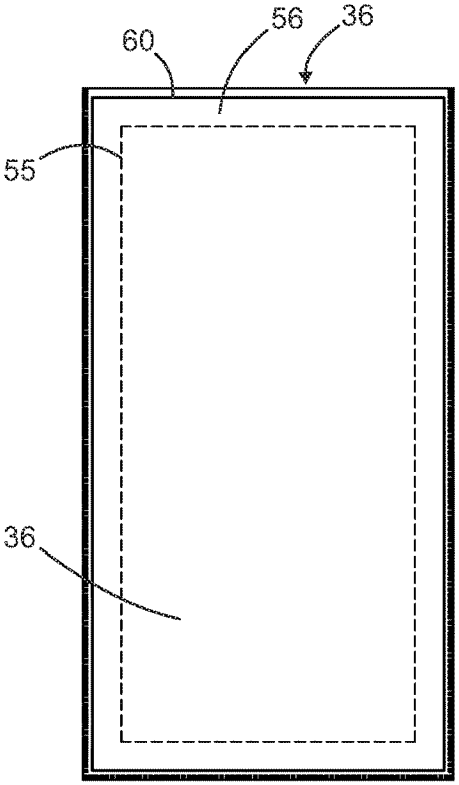
FIG. 4B is a bottom view of the top sheet illustrating one embodiment of the top sheet being releasably attached to the top blanket.
Figure 4A:
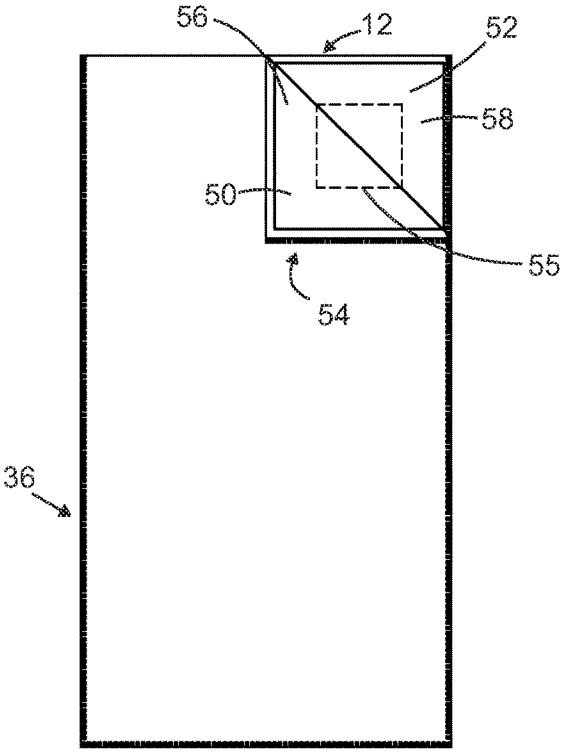
FIG. 4A is a top view of the bedding system in its made-condition, illustrating a top sheet/top blanket combination corner being folded exposing a top sheet and a bottom sheet.

FIG. 4A shows an illustrative top view representation in which the bedding system is in its made-condition. The top sheet/top blanket combination corner 54 is folded and exposing the top sheet 50 and bottom sheet 52, whereas bottom sheet 52 is attached to bottom blanket 12. Stitching 55 create channels 56 and 58 to cover the releasable top sheet/top blanket attachments (not shown) and releasable bottom sheet/bottom blanket attachments (not shown), as discussed in detail below.

FIG. 4B shows an illustrative bottom view representation in which the top sheet 50 is releasably attached to the top blanket 36. Stitching 55 create a channel 56 being disposed along top sheet edges 60 to cover the releasable top sheet/top blanket attachments (not shown), as discussed in detail below.

FIG. 4C shows an illustrative top view representation in which the bottom sheet 52 is releasably attached to the bottom blanket 12. Stitching 55 create a channel 58 disposed along the bottom of the sheet edges 62 to cover the releasable bottom sheet/bottom blanket attachments (not shown), as discussed in detail below.

Figure 5B:
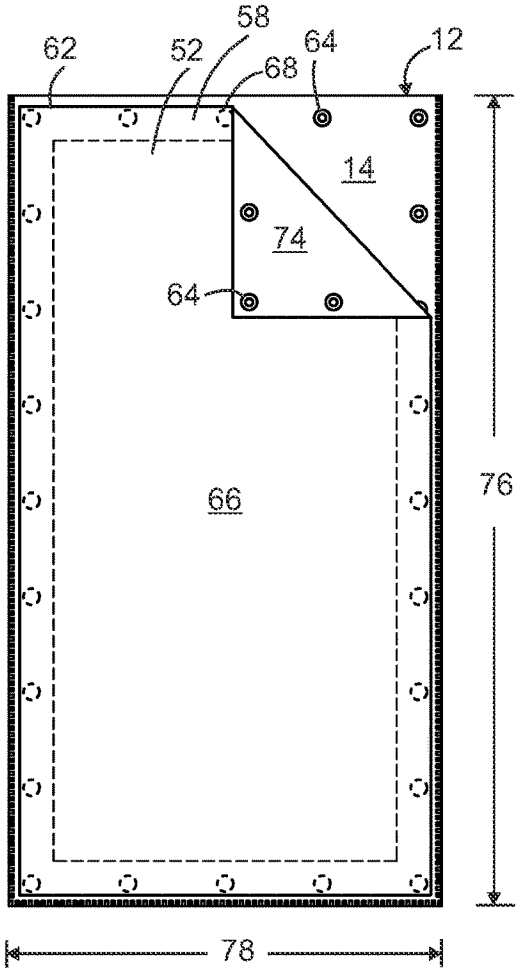
FIGS. 5A and 5B illustrate one embodiment of the releasable attachments of the bottom sheet and the bottom blanket.
Figure 5A:
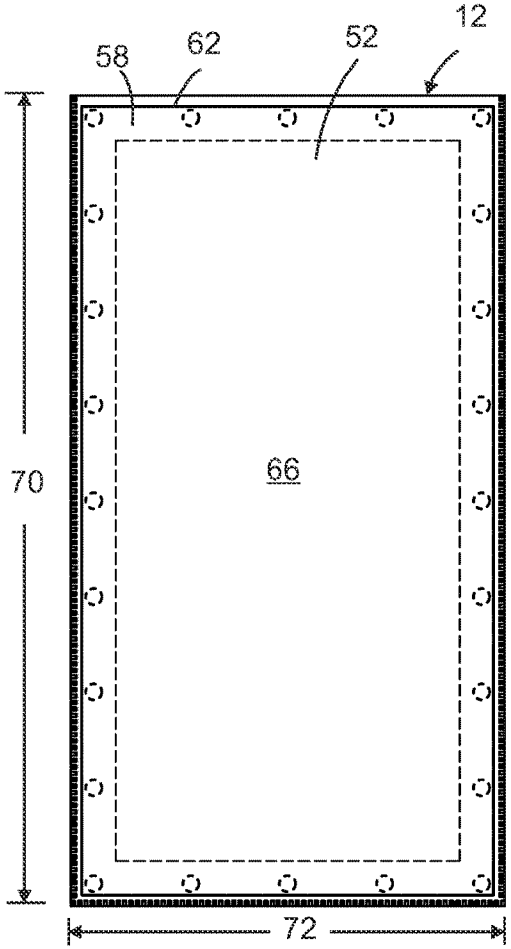

FIGS. 5A and 5B show illustrative representations in which the releasable attachments are male and female snap fasteners 64 exposed on the bottom surface 74 of the bottom sheet 50 and on the top surface 14 of the bottom blanket 12, respectively. Whereby, channel 58 hides fasteners 64 on the top surface 66 of the bottom sheet 52 so that the user can only feel the fabric of channel 58 on their skin and not the snap tops 68.

One of ordinary skill in the art will appreciate the other many ways to attach the bottom sheet 52 to bottom blanket 12. The fasteners 64 can be substituted with hook and loop material and interconnecting zippers. The two additional examples of fasteners 64 are disclosed herein for illustration purposes and not to limit the present invention. The hook and loop material (not shown) of releaseable fasteners 64 can be disposed on the bottom surface 74 of the bottom sheet 50 and the top surface 14 of the bottom blanket 12. Zippers (not shown) of releaseable fasteners 64 can be disposed on the bottom sheet edges 62 and along the four sides 18 of the bottom blanket top surface 14.

A length 70 and width 72 of bottom sheet 52 may be less than a length 76 and width 78, respectively, of the top surface 14 of the bottom blanket 12. This dimensional implementation may eliminate an overhang that would interfere with zippering the bedding system.

Figure 6A:
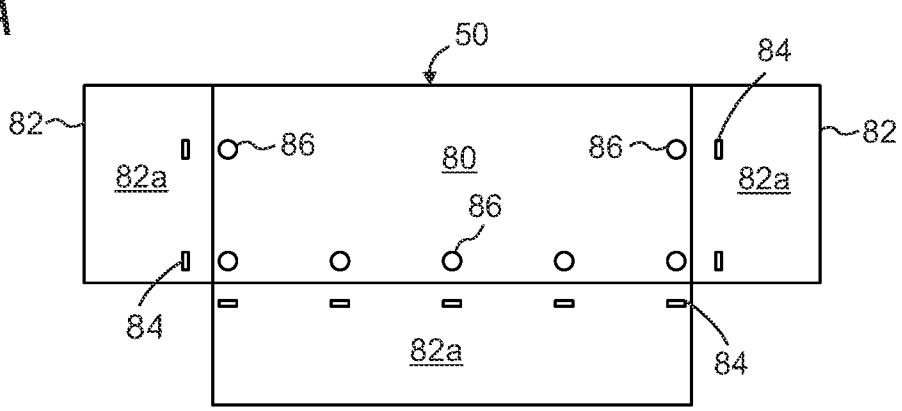
FIGS. 6A and 6B are partial views of an end of the top surface of the top sheet, illustrating another embodiment in which panels extend from top sheet edges beyond the zippers of the bottom blanket.
Figure 6B:
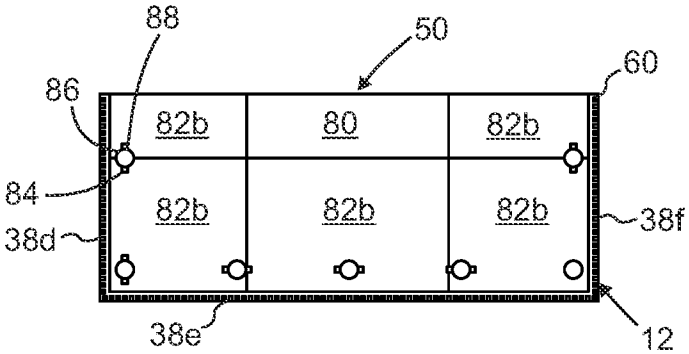

FIG. 6A show illustrative representations of partial views of an end of top sheet 50 in which the top surface 80 of top sheet 50 has three panels 82 extending from top sheet edges 60 beyond zippers 38*a-c* of the top blanket 36 and zippers 38*d-f* of the bottom blanket 12 (FIG. 3). FIG. 6B shows the top sheet 50 in the tucked position on the bottom blanket 12 illustrating zippers 38*d-f* of the bottom blanket 12 being outward relative to top sheet edges 60. The top sheet's overhanging panels 82 provide coverage along the top sheet edges 60 if the user prefers to sleep either partially or fully unzipped. Depending on the user's preferences, the top sheet 50 could be a lighter fabric such as cotton or heavier fabric such as microfleece. Panels 82 can have releasable attachments, such as button holes 84 sewn in that line up with other fasteners 86, such as snaps or buttons, disposed along the top sheet top surface 80 so that all three overhangs or parts of them can be tucked and buttoned out of the way between the top sheet and top blanket by users who prefer to keep all or most of the bedding zipped up when sleeping. Matching fastbers 86*a* (See FIG. 7B) are disposed on the bottom surface 92 to snap together with fasteners 86, whereby attaching or connecting the top sheet 50 to the bottom blanket 12 The number of panels 82 will depend on the size of the sheets and blankets and preference of users. The use of three panels herein is for illustrative purposes only and not intended to limit the present invention.

FIG. 6A illustrates panels 82 out, in an untucked position, with the panel top surfaces 82*a* exposed. FIG. 6B illustrates panels 82 folded over onto top sheet top surface 80, in a tucked position, with the panel bottom surfaces 82*b* exposed allowing the folded panel 82 to be fully positioned between the top sheet and top blanket (as shown in FIG. 3).

The panel attachment mechanism to the top sheet 80 is not intended to limit the disclosure to the fastener-hole (86-84) configuration. Other suitable panel attachment mechanisms can include hooks and loops (See FIGS. 7A and 7B) disposed on panel top surface 82*a* and top sheet top surface 80.

Figure 7A:
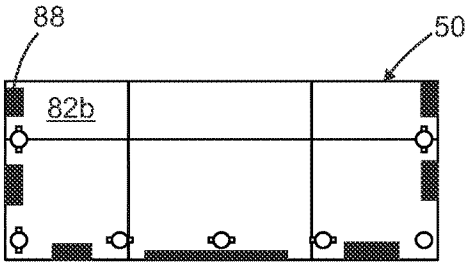
FIG. 7A is a partial top view of the top sheet illustrating with the panels in the tucked position depicting releasable attachments disposed on the bottom surface of the panels, which is also top sheet bottom surface.
Figure 7B:
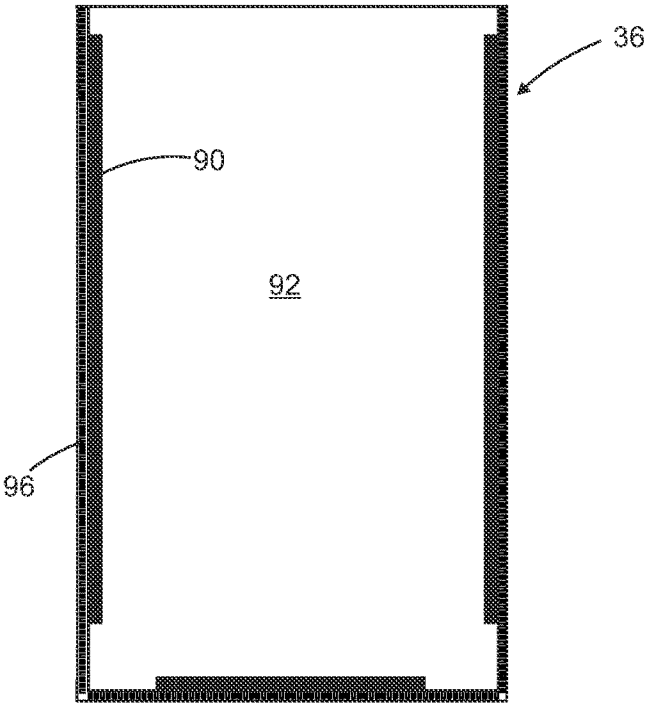
FIG. 7B is a bottom view of the top blanket depicting releasable attachments disposed on the bottom surface of the top blanket.

FIGS. 7A and 7B show illustrative representations in which releasable attachments 88, 90, such as hook and loop fasteners, are disposed on the panel bottom surface 82*b* and top blanket bottom surface 92. When the panel 82 is in the tucked position exposing panel bottom surface 82*b* upwardly, the releasable attachment 90 of the top blanket bottom surface 92 can engage the releasable attachment 88 of panel bottom surface 82*b* and releasably attach top sheet 50 to top blanket 36. Releasable attachments 88, 90 are shown as bands along the perimeters 94, 96 of the panel bottom surface 82*b* and top blanket bottom surface 92. However, one skilled in the art can determine whether to use one band or a plurality of bands on perimeters 96 separated by a predetermined distance with a predetermined width that will sufficiently retain the top sheet 50 to the top blanket 36, so when the bedding system is removed from the structure and placed upon another structure, the top sheet will be oriented in its proper position within bedding system.

Figure 8C:
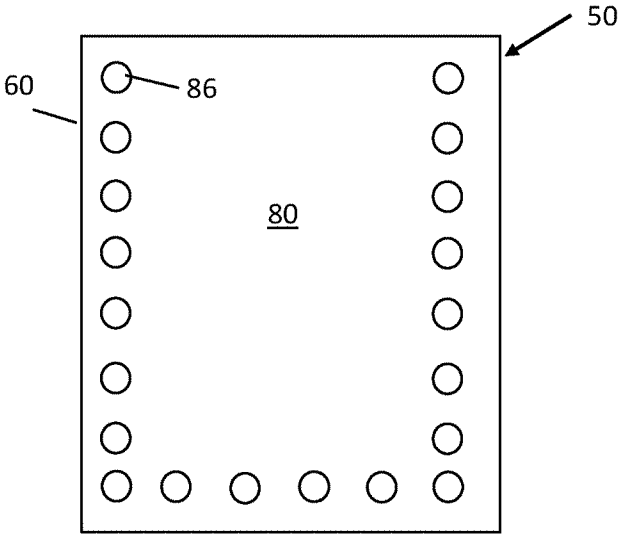
FIG. 8C a top view of the top sheet illustrating snaps to attach it to the top blanket.
Figure 8D:
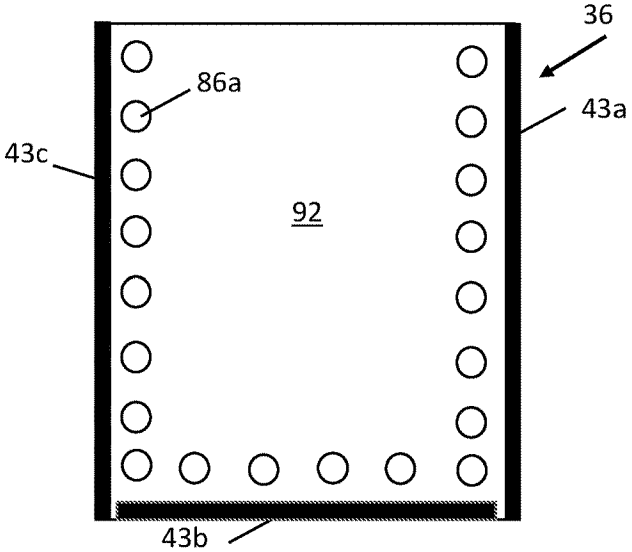
FIG. 8D is a bottom view of the top blanket illustrating mating snap to attach it to the top sheet.
Figure 8A:
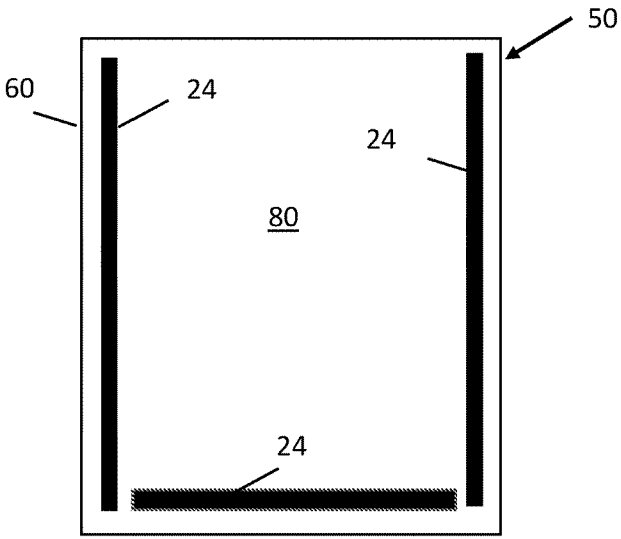
FIG. 8A a top view of the top sheet illustrating zippers to attach it to the top blanket.
Figure 8B:
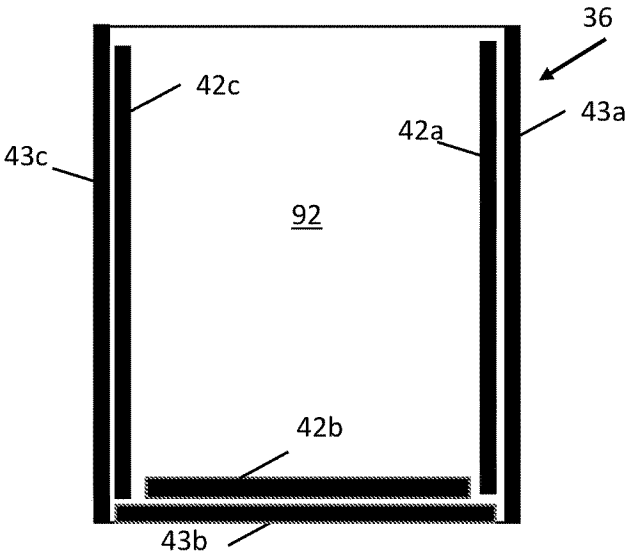
FIG. 8B is a bottom view of the top blanket illustrating inner zippers to attach it to the top sheet.

Now turning to FIG. 8A and FIG. 8B for yet another embodiment of a top sheet/top blanket attachment mechanism. Inner left, end, and right zippers 42*a*, 42*b*, and 42*c*, respectively, are disposed on the top blanket bottom surface 92 and left, end, and right zippers 24*a*, 24*b*, and 24*c*, respectively, are disposed on top surface 80 along top sheet edges 60. Wherein, zippers 24, 42 are juxtaposition to interconnect therewith, whereby top sheet 50 is capable of being releasably attached to top blanket 36. Though the figures show a plurality of zippers 42, 24, one of ordinary skill in the art understands that only one zipper pair may be used to accomplish the objective of attaching the top sheet to the top blanket. Top blanket left, right, and outer zippers 43*a*, 43*b*, 43*c*, respectively are the same as left, end and right zippers 38*a*, 38*b*, and 38*c*, respectively FIGS. 8C and 8D show alternative fastener mechanism embodiment to attach or connect top sheet 50 to top blanket 12. shown on F Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. A bedding system adaptable to fit on a mattress, the bedding system including a bottom blanket, a top blanket, a bottom sheet, and a top sheet, comprising:

the bottom blanket, forming a single layer, being directly releasably attachable to the top blanket, in which a bottom surface of the bottom blanket is in direct contact with and at least partially encapsulates the mattress, wherein the top blanket has a releasable attachment mechanism extending along three sides configured to interconnect with a releasable attachment mechanism also extending along three sides of the bottom blanket, whereby three sides of the bedding system are closed when the top blanket releasable attachment mechanism interconnect with the bottom blanket releasable attachment mechanism, and wherein the top blanket's releasable attachment mechanism is positioned on its edges and the bottom blanket's releasable attachment mechanism is a distance from its edges;

the bottom sheet, forming a single layer and positioned between the top sheet and the bottom blanket, includes a bottom surface that is releasably attachable to a top surface of the bottom blanket; and the top sheet, forming a single layer, disposed between a top surface of the bottom sheet and a bottom surface of the top blanket, wherein the bottom sheet and the top sheet are at least partially encapsulated when the bottom blanket is attached to the top blanket.

2. The bedding system of claim 1, wherein the top sheet is releasably attached to the top blanket.

3. The bedding system of claim 1, wherein the bottom sheet has a length dimension and a width dimension, whereby each being less than a length dimension and a width dimension, of the top surface of the bottom blanket, respectively.

4. The bedding system of claim 1, wherein the bottom blanket further comprises a pocket fixedly attached to a plurality of sides of the bottom surface of the bottom blanket, wherein the pocket includes an opening opposing the bottom surface of the bottom blanket.

5. The bedding system of claim 4, wherein the opening has a width dimension and a length dimension at least equal to a width dimension and a length dimension of the bottom surface of the bottom blanket, and the opening further comprises an elastic material to close the opening after being fitted onto the structure, whereby the bedding system is secured to the structure.

6. The bedding system of claim 1, further comprising two or more panels extending from two or more sides of the top sheet.

7. The bedding system of claim 6, wherein the two or more panels have a plurality of panel releasable attachments and the top sheet top surface have a plurality of top sheet top surface releasable attachments, whereby the plurality of panel releasable attachments attaches to the plurality of top sheet top surface releasable attachments forming a tucked position.

8. The bedding system of claim 7, wherein the plurality of top sheet top surface releasable attachments are fasteners disposed on a top surface of the top sheet and the plurality of panel releasable attachments are holes disposed on the two or more panels and juxtaposition the fasteners, whereby the two or more panels are capable of being folded on to the top surface of the top sheet and the holes are fitted onto the fasteners releasably attaching the two or more panels to the top surface of the top sheet and disposed between the top sheet and the blanket.

9. The bedding system of claim 7, wherein the two or more panels have a bottom surface each with a respective hook and loop material and the top blanket has a bottom surface with a hook and loop material, whereby the top sheet is adapted to being attached to the top blanket when the two or more panels bottom surface hook and loop materials interconnect with the top blanket bottom surface hook and loop material while in the tuck position.

10. The bedding system of claim 1, wherein the bottom sheet has releasable attachments disposed on its bottom surface and the bottom blanket has releasable attachments disposed in its top surface.

11. The bedding system of claim 10, wherein the bottom sheet releasable attachments have a plurality of male snaps along its sides and the bottom blanket releasable attachments have a plurality of female snaps along its sides juxtaposition the plurality of male snaps of the bottom sheet, whereby the bottom sheet is capable of being releasably attached to the bottom blanket when the plurality of male snaps connect with the plurality of female snaps.

12. The bedding system of claim 11, wherein the bottom sheet includes a plurality of channels that border the sides of a top surface of the bottom sheet enclosing the plurality of male snaps, whereby a user will not be discomforted by the plurality of male snaps.

13. The bedding system of claim 2, wherein a top surface of the top sheet includes a releasable attachment and a bottom surface of the top blanket includes a releasable attachment, whereby the top sheet is releasably attached to the top blanket when the top sheet top surface releasable attachment is engaged with the top blanket bottom surface releasable attachment.

14. The bedding system of claim 13, wherein the top sheet top surface releasable attachment includes hook and loop material along its sides and the top blanket bottom surface releasable attachment includes hook and loop material along its sides juxtaposition the hook and loop material of the top sheet, whereby the top sheet is capable of being releasably attached to the top blanket.

15. The bedding system of claim 1, wherein the structure is a mattress.

16. The bedding system of claim 8, wherein the fasteners are buttons.

17. The bedding system of claim 10, wherein the releasable attachments are hook and loop material.

18. The bedding system of claim 10, wherein the releasable attachments are zippers.

19. The bedding system of claim 13, wherein the top sheet top surface releasable attachment includes one or more zippers along its sides and the top blanket bottom surface releasable attachment includes zippers along its sides juxtaposition the zippers of the top sheet, whereby the top sheet is capable of being releasably attached to the top blanket.

* * * * *